US008678214B2

(12) United States Patent
Berry-Smith

(10) Patent No.: US 8,678,214 B2
(45) Date of Patent: Mar. 25, 2014

(54) BOTTLE HOLDER FORMED FROM A SINGLE BLANK

(75) Inventor: Matthew P. Berry-Smith, Wamboin (AU)

(73) Assignees: Matthew Philip Berry-Smith, Wamboin (AU); Martin Paul Donaghue, Deakin (AU)

( * ) Notice: Subject to any disclaimer, the term of this patent is extended or adjusted under 35 U.S.C. 154(b) by 0 days.

(21) Appl. No.: 13/498,119

(22) PCT Filed: Sep. 24, 2010

(86) PCT No.: PCT/AU2010/001254

§ 371 (c)(1), (2), (4) Date: Aug. 23, 2012

(87) PCT Pub. No.: WO2011/035384

PCT Pub. Date: Mar. 31, 2011

(65) Prior Publication Data

US 2012/0312830 A1 Dec. 13, 2012

(30) Foreign Application Priority Data

Sep. 25, 2009 (AU) ..... 2009904708

(51) Int. Cl.
*B65D 23/12* (2006.01)
*A47G 23/02* (2006.01)

(52) U.S. Cl.
CPC ..... *A47G 23/0241* (2013.01)
USPC ..... 215/395; 220/737; 220/62

(58) Field of Classification Search
CPC ..... A47G 23/0241; A47G 23/0216; A47G 23/0208; A47G 23/02
USPC ..... 220/738, 737, 62, 739, 903; 215/395
IPC ..... B65D 23/12
See application file for complete search history.

(56) References Cited

U.S. PATENT DOCUMENTS

| | | | | |
|---|---|---|---|---|
| 1,736,383 | A * | 11/1929 | Waggoner | 150/154 |
| 1,917,953 | A | 7/1933 | Davis | |
| 1,996,997 | A | 4/1935 | Inman | |
| 2,263,122 | A * | 11/1941 | De Haven | 215/395 |
| 4,648,525 | A * | 3/1987 | Henderson | 220/739 |

(Continued)

OTHER PUBLICATIONS

International Search Report for International Application no. PCT/AU2010/001254 mailed Oct. 27, 2010.

(Continued)

*Primary Examiner* — Robert J Hicks
(74) *Attorney, Agent, or Firm* — Osha Liang LLP

(57) ABSTRACT

One aspect of the invention provides a cardboard bottle holder able to be supplied flat and easily configured into a secure shape able to hold a variety of different bottles and cans. The bottle holder comprises a single piece of cardboard shaped to form a generally rectangular body part having: a first slot in a first side adjacent a first end, to define a tab extending along part of the first end; and a second slot in a second side opposite the first side, adjacent a second end opposite the first end, to define a tab extending along part of the second end in the opposite direction to the first tab. The lengths of the first and second slots are designed so that they can be engaged with each other to hold the generally rectangular part in a generally cylindrical form with the ends brought together to overlap each other.

6 Claims, 7 Drawing Sheets

(56) References Cited

U.S. PATENT DOCUMENTS

| | | | | | |
|---|---|---|---|---|---|
| 4,685,583 | A | * | 8/1987 | Noon | 220/710.5 |
| 5,169,025 | A | * | 12/1992 | Guo | 220/739 |
| 5,209,367 | A | | 5/1993 | Van Musscher et al. | |
| 5,842,633 | A | | 12/1998 | Nurse | |
| 5,857,615 | A | * | 1/1999 | Rose | 229/403 |
| 6,026,983 | A | * | 2/2000 | Graham | 220/738 |
| 6,883,765 | B2 | * | 4/2005 | Lozano et al. | 248/300 |

OTHER PUBLICATIONS

Written Opinion for International Application No. PCT/AU2010/001254 mailed Oct. 27, 2010.

* cited by examiner

BOTTLE HOLDER FORMED FROM A SINGLE BLANK

CROSS-REFERENCE TO RELATED APPLICATIONS

This application is the national phase application pursuant to 35 U.S.C. §371 of International Application No. PCT/AU2010/001254, filed Sep. 24, 2010, which claims the benefit of priority of Australian Patent Application No. 2009904708, filed Sep. 25, 2009. These applications are hereby incorporated herein by reference in their entireties.

TECHNICAL FIELD

This invention concerns a cardboard bottle holder able to be supplied flat and easily configured into a secure shape able to hold a variety of different bottles and cans.

BACKGROUND ART

Bottle holders, known as 'stubby holders' are well known in Australia for holding cold beer bottles and cans. They are made from a variety of materials such as expanded polystyrene and neoprene, that provide thermal insulation to a cold beverage on a hot day.

DISCLOSURE OF THE INVENTION

The invention is a bottle holder comprising a single piece of cardboard shaped to form:

A generally rectangular body part having:

- a first slot in a first side adjacent a first end, to define a tab extending along part of the first end,
- a second slot in a second side opposite the first side, adjacent a second end opposite the first end, to define a tab extending along part of the second end in the opposite direction to the first tab.
- Wherein, the lengths of the first and second slots are designed so that they can be engaged with each other to hold the generally rectangular part in a generally cylindrical form with the ends brought together to overlap each other.

And, a second part comprising a head with a wing extending from each side,

- wherein the head is connected to a side of the body part by a neck,
- the wings are connected to the head by respective waisted regions that facilitate folding of the leading or trailing edges of the wings, or both, along longitudinal axes of the wings,
- the arrangement being such that as the head is folded to close one end of the cylindrical form, the folded wings are inserted into the cylindrical form where they are compressed against the body part by the insertion of a bottle, to capture the head as a base for the bottle holder.

It is an advantage of the invention that it provides an environmentally friendly, inexpensive option to the current oil based more expensive bottle holders on the market and requires no adhesives for assembly. At the same time the bottle holder provides an outer surface that allows for the printing of hi-resolution graphics. A recycled material, corrugated cardboard, may be used for manufacture of the bottle holders, as it is a cheap and plentiful material with insulating properties. It is also an advantage that the bottle holder is able to hold multiple beverage containers types such as stubbies and cans.

The distal ends of the wings may be angled to facilitate insertion into the cylindrical form.

One of the tabs may be shorter than the other, and its outer distal edge may be radiused to assist assembly.

The opening of the slot adjacent the other tab may also be radiused, on the body side of the slot, to assist assembly.

The edge of the body opposite the neck may be recessed to create a space where the lips of a drinker contact a can.

The cardboard may be corrugated with the corrugations running around the sides for better insulation.

BRIEF DESCRIPTION OF THE DRAWING

An example of the invention will now be described with reference to the accompanying drawings, in which.

BEST MODES OF THE INVENTION

Figure 1:
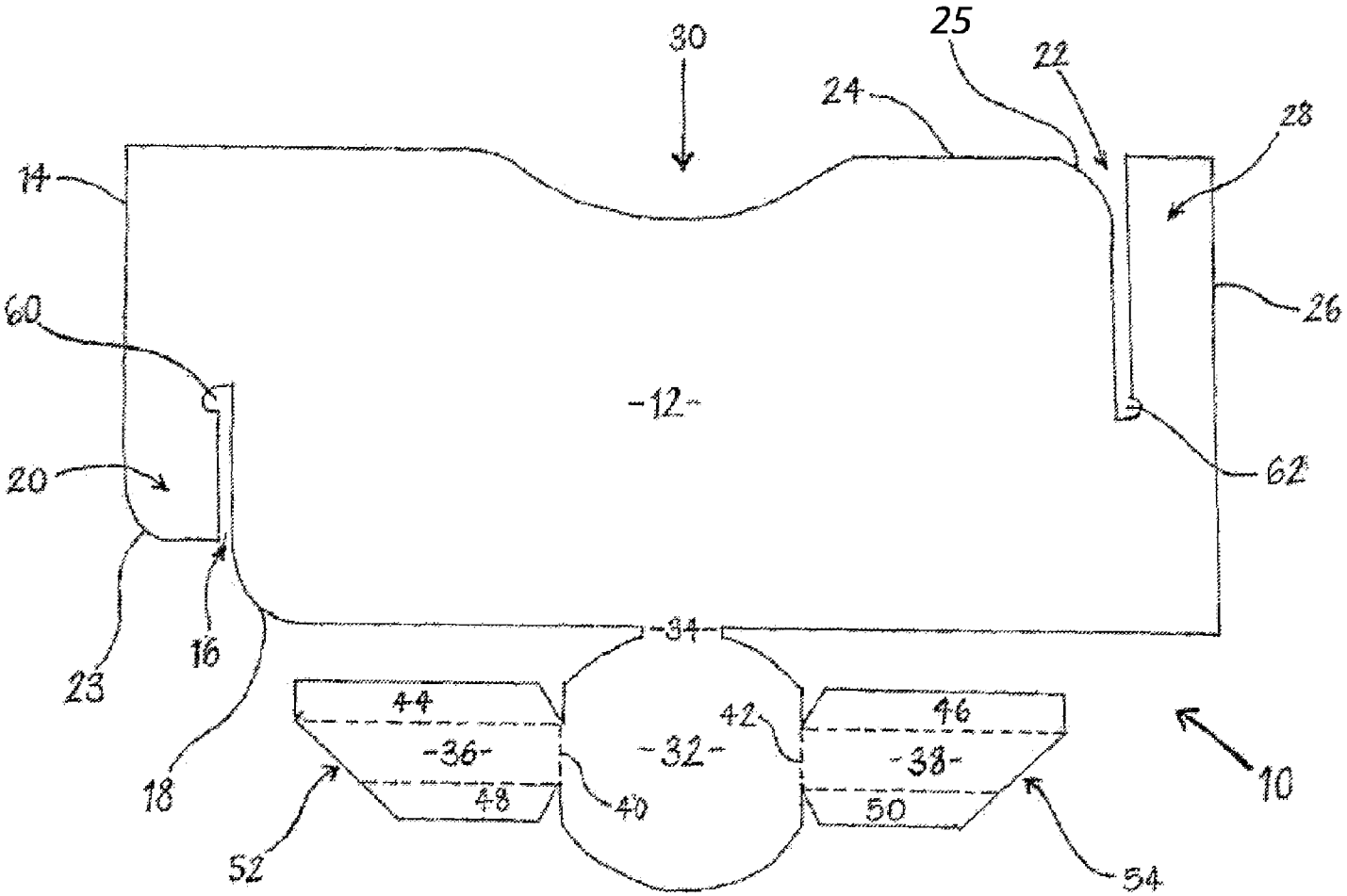
FIG. 1 which is a diagram of a bottle holder in its flat configuration.

Referring first to FIG. 1 the bottle holder 10 is a single piece of cardboard shaped to form a generally rectangular body part 12. At a first end 14 of body 12 there is a first slot 16 extending from a first side 18 adjacent and parallel to the first end 14, to define a tab 20 extending along part of the first end 14. The outer end 23 of tab 20 is radiused.

A second slot 22 is formed in the other side 24, adjacent and parallel to a second end 26, to define a second tab 28 extending along part of the second end 26 in the opposite direction to the first tab 20. The inner edge 25 of slot 22 is radiused.

A curved recess 30 is cut into the centre section of the second side 24. This curved recess 30 can be moved to the left or right along side 24 to provide finger grip clearance away from tabs 20 and 28 in use to provide a comfortable grip.

Each slot 16 and 22 has a widened end 60 and 62 respectively.

A head 32 is connected to body part 12 by a neck 34 in the centre of the first side 18. On each side of the head 32 there is a wing 36 and 38. Each wing 36 and 38 is connected to the head 32 by a respective waisted region 40 and 42 marked by dotted lines. Along the length of each wing, extending from the ends of the waisted regions, there are also dotted lines that demark the leading 44, 46 and trailing 48, 50 edges. The wingtips are angled at 52 and 54.

The cut-out is marked onto a cardboard box containing two dozen bottles of beer. The outside of the box is printed with colours and any desired logo. It may also be printed with instructions for assembling the bottle holder. Scoring is also provides to ensure that the user folds the cardboard at the correct points and provides a smooth and consistent curve/finish for the outside of the cylindrical wall.

In this example the bottle holder is assembled as follows:

1. First the cut-out must be removed from the box wall. Scoring on the inside of the box provides lines of weakness to enable the cut-out to be torn out.

Figure 2:
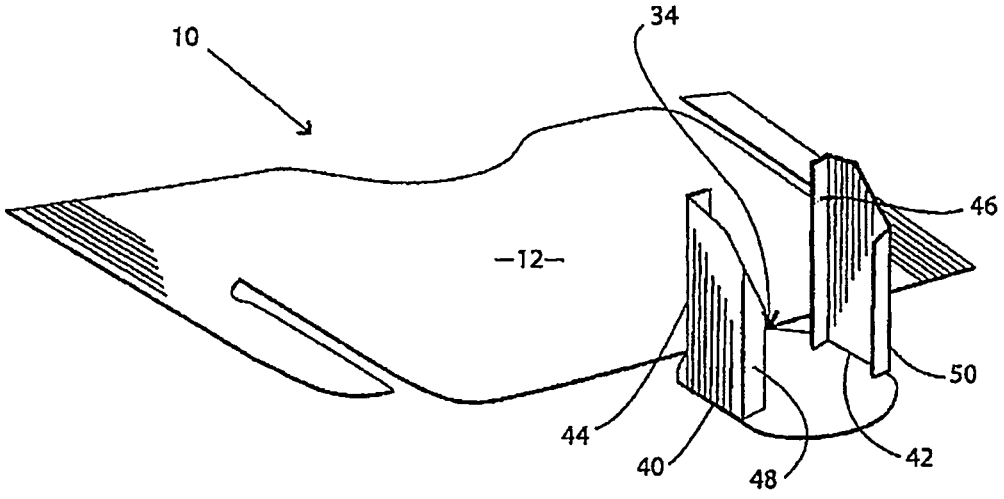
FIGS. 2, 3(*a*), 3(*b*) and 4 is a pictorial view of the bottle holder at various stages in its assembly.

2. As shown in FIG. 2, fold cardboard away along all dotted lines 40, 42, 44, 46, 48 and 50, to 90 degrees then released.

3. For the best results it is highly recommended that the outer surface, that will wrap around the bottle, be first bent around the bottle to form a loose cylindrical shape. The inside of the cardboard box may be scored in the vertical direction with respect to the bottle to facilitate bending in a smooth curve.

Figure 3A:
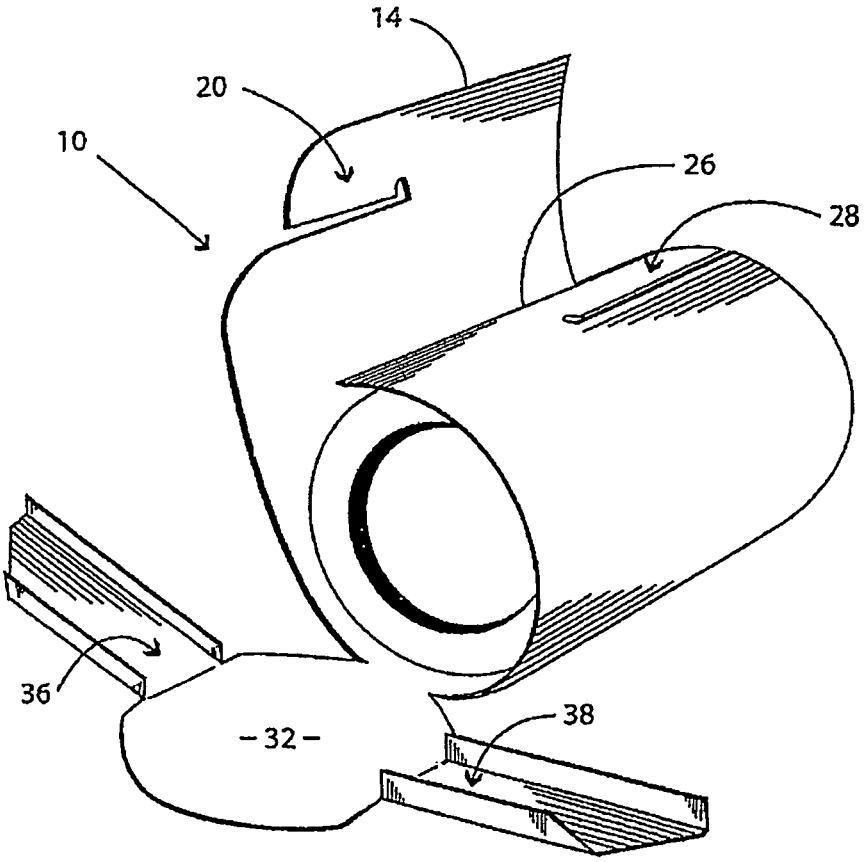
Figure 3B:
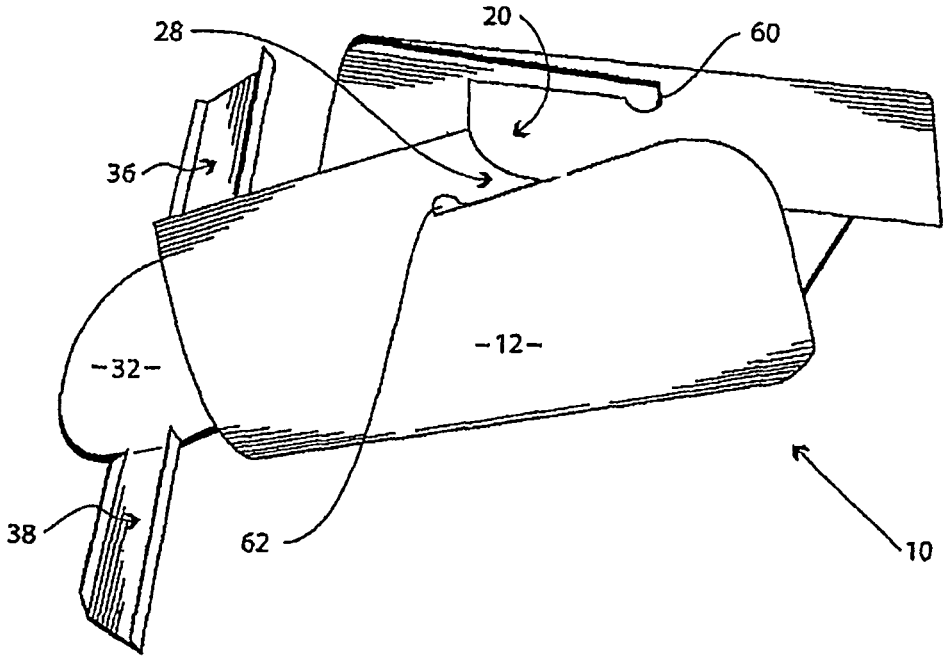

4. Next the ends 14 and 26 are joined by placing the short tab 20 over and into the long slot 22. This process is shown in FIG. 3(*a*) and FIG. 3(*b*) The body 12 forms a cylindrical tube. The widened ends 60 and 62 provide a small amount of give so that the diameter of the cylinder is slightly adjustable based on the width of the inserted bottle. These widened ends 60 and 62 lock the tabs 20 and 28 into position.

5. The wings 36 and 38 on the head 32 are then folded up.

Figure 4:
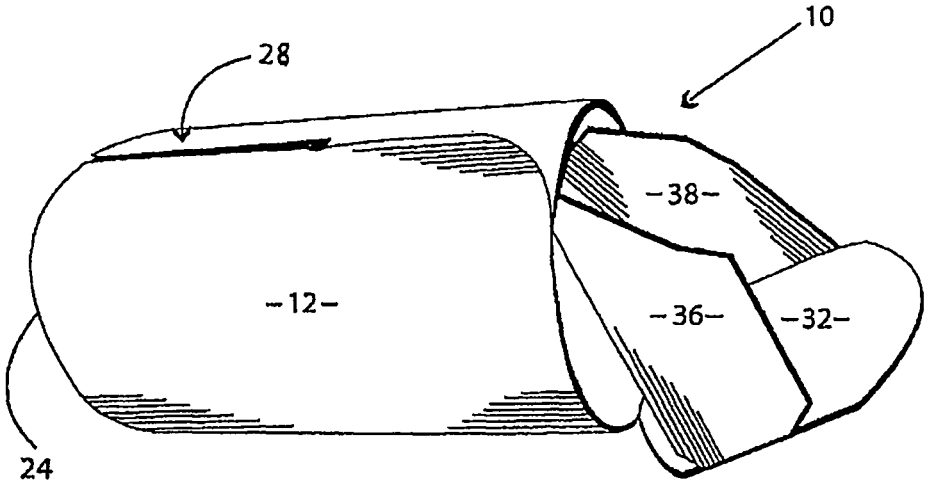

6. As shown in FIG. 4, next the folded head 32 is guided into position with the wings 36 and 38 are positioned within the cylinder with their folded edges pressing against the inside of the cylinder.

Figure 5:
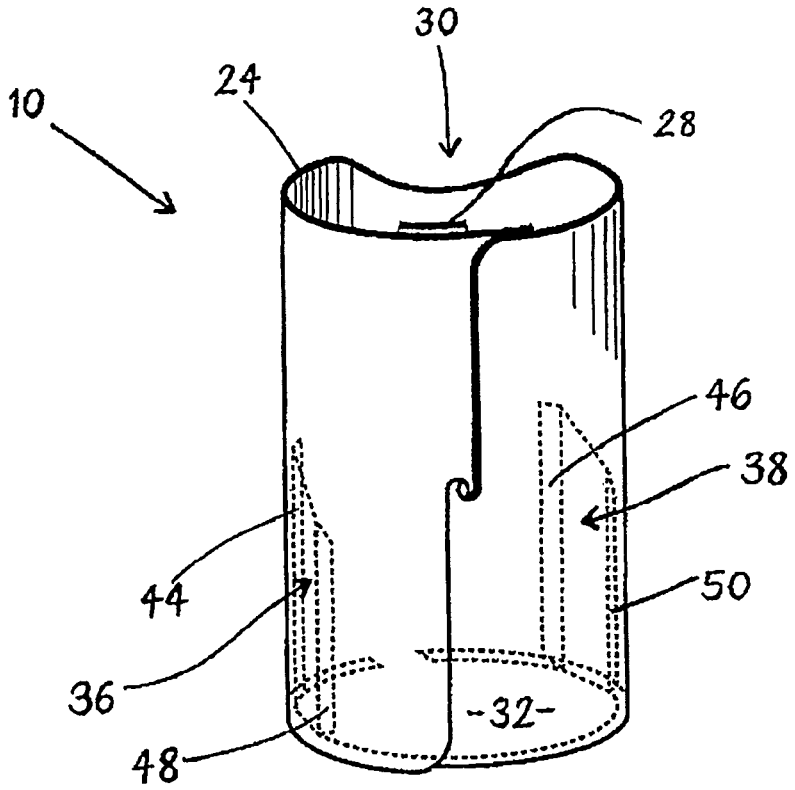
FIG. 5 is a pictorial view of the bottle holder its assembled; cylindrical configuration with the internally captured wings visible.
Figure 6:
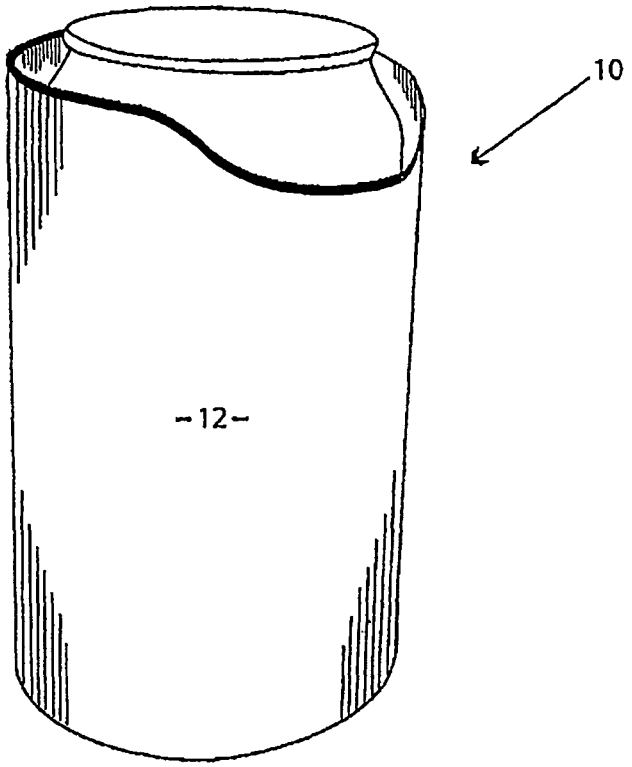
FIG. 6 is a pictorial view of the exterior of the bottle holder in its assembled cylindrical configuration while holding a can.

7. A bottle or can is now guided into the top of the cylinder with a twisting motion. The folded wings 36 and 38 are now captured between the bottle and the internal wall of the cylinder as shown in FIG. 5. This stops the base from dropping down and the therefore the bottle from slipping through. The result is shown in FIG. 6.

8. With cans, the opening of the can is aligned with curved recess 30 to avoid any uncomfortable contact between the lips and the bottle holder when in use.

To disassemble, remove the can or bottle from the cooler. This action effectively unlocks the head as the wings that are connected to the head are no-longer kept in a firm vertical position within the cylinder's wall. Pull the head down and the wings will follow. Undo the tabs and the cooler can be stored away flat. To reassemble follow the assembly steps again.

The assembled bottle holder, shown in FIG. 2 has the following dimensions:

Depth: close to the same depth of the standard 375 ml can.

The cylinder diameter: Allows for standard size 375 ml cans, glass bottles and stubbies. To fit the more narrow cans and bottles the overall size of the template would need to be reduced.

The wings: Are integral in that they lock the head into position restricting the can/bottle from slipping through. They are close in length to the diameter measure of the circular base. Any longer, and the user would have trouble placing them within the cylinder.

In production, one colour basic designs with no colour tones or screens can be printed directly on cardboard that has a white or brown coloured surface. For more colourful and hi resolution results a separate sheet (gloss, matt or satin finish) is firstly printed with the designs (up to nine different designs can be printed on the sheet) in full colour and then veneered to the surface of the cardboard. Once securely attached to the cardboard the shape of the bottle holder is scored into the cardboard using a die that is in the desired shape of the template. Sections of the design that require scoring are also done during this cutting process. The cardboard is then made into the box with the usual process.

It is important to note that the direction of the corrugation is horizontal around the bottle as it will provide better insulation and shaping of the bottle holder.

It will be appreciated by persons skilled in the art that numerous variations and/or modifications may be made to the invention as shown in the specific embodiments without departing from the scope of the invention as broadly described.

For example, the bottle holder may not be incorporated into a box. Instead, the bottle holder may be sold in sets or handed out as part of promotions at events. In this case during production the bottle holder is cut/punched out of the cardboard using a die that is in the desired shape of the template.

The present embodiments are, therefore, to be considered in all respects as illustrative and not restrictive.

The claims defining the invention are as follows:

1. A bottle holder comprising a single piece of cardboard shaped to form:

a generally rectangular body part having:

a first slot in a first side adjacent a first end, to define a first tab extending along part of the first end, a second slot in a second side opposite the first side, adjacent a second end opposite the first end, to define a second tab extending along part of the second end in the opposite direction to the first tab, wherein, the lengths of the first and second slots are designed so that they can be engaged with each other to hold the generally rectangular part in a generally cylindrical form with the ends brought together to overlap each other; and, a second part comprising a head with a wing extending from each side, wherein:

the head is connected to a side of the body part by a neck, the wings are connected to the head by respective waisted regions that facilitate folding of leading or trailing edges of the wings, or both, along longitudinal axes of the wings, and the arrangement is such that as the head is folded to close one end of the cylindrical form, the folded wings are inserted into the cylindrical form where they are compressed against the body part by the insertion of a bottle, to capture the head as a base for the bottle holder.

2. A bottle holder according to claim 1, wherein each of the wings defines a distal end and the distal ends of the wings are angled to facilitate insertion into the cylindrical form.

3. A bottle holder according to claim 1, wherein one of the first tab or second tab is shorter than the other, and an outer distal edge of the shorter tab is radiused to assist assembly.

4. A bottle holder according to claim 3, wherein the opening of the slot adjacent the first or second tab that is not shorter that the other is also radiused, on the inner side of the slot, to assist assembly.

5. A bottle holder according to claim 1, wherein an edge of the body opposite the neck is recessed to create a space where the lips of a drinker contact a can.

6. A bottle holder according to claim 1, wherein the cardboard is corrugated with the corrugations running around the sides of the bottle holder.

* * * * *

UNITED STATES PATENT AND TRADEMARK OFFICE

CERTIFICATE OF CORRECTION

PATENT NO. : 8,678,214 B2
APPLICATION NO. : 13/498119
DATED : March 25, 2014
INVENTOR(S) : Matthew P. Berry-Smith It is certified that error appears in the above-identified patent and that said Letters Patent is hereby corrected as shown below:

In the Claims:

At column 4, claim number 4, line number 50, "that the other" should read

--than the other--.

Signed and Sealed this
Twenty-sixth Day of May, 2015

Michelle K. Lee

Michelle K. Lee
*Director of the United States Patent and Trademark Office*